US007010870B2

(12) United States Patent
Mick et al.

(10) Patent No.: US 7,010,870 B2
(45) Date of Patent: Mar. 14, 2006

(54) TUFTED FOAM INSOLE AND TUFTED FOOTWEAR

(75) Inventors: Todd Murray Mick, New York, NY (US); Gail Elizabeth Reynolds, Cincinnati, OH (US); Kristina Kimberly Orbegozo, Cincinnati, OH (US); Deborah D. Loesel, New York, NY (US)

(73) Assignee: totes Isotoner Corporation, Cincinnati, OH (US)

( * ) Notice: Subject to any disclaimer, the term of this patent is extended or adjusted under 35 U.S.C. 154(b) by 49 days.

(21) Appl. No.: 10/610,672

(22) Filed: Jul. 1, 2003

(65) Prior Publication Data

US 2005/0000114 A1 Jan. 6, 2005

(51) Int. Cl.
*A43B 13/38* (2006.01)

(52) U.S. Cl. ..... 36/44; 36/9 R

(58) Field of Classification Search ..... 36/43, 36/44, 9 R

See application file for complete search history.

(56) References Cited

U.S. PATENT DOCUMENTS

| | | | | |
|---|---|---|---|---|
| 541,814 | A | 6/1895 | King | |
| 1,011,460 | A | 12/1911 | Maddocks | |
| 2,100,492 | A | 11/1937 | Sindler | 154/2 |
| 2,605,560 | A | 8/1952 | Gouabault | 36/29 |
| 2,677,904 | A | 5/1954 | Reed | 36/29 |
| 2,817,163 | A | 12/1957 | Clark | 36/17 |
| 2,863,230 | A | 12/1958 | Cortina | 36/29 |
| 3,120,712 | A | 2/1964 | Menken | 36/29 |
| 3,608,215 | A | 9/1971 | Fukuoka | |
| 4,012,855 | A | 3/1977 | Gardner | 36/29 |
| 4,016,662 | A | 4/1977 | Thompson | 36/29 |
| 4,129,951 | A | 12/1978 | Petrosky | 36/29 |
| 4,133,118 | A | 1/1979 | Khalsa et al. | 36/83 |
| 4,170,078 | A | 10/1979 | Moss | 36/28 |
| 4,192,086 | A * | 3/1980 | Sichak | 36/44 |
| 4,245,406 | A | 1/1981 | Landay et al. | 36/14 |
| 4,316,332 | A | 2/1982 | Giese et al. | 36/28 |
| 4,319,412 | A | 3/1982 | Muller et al. | 36/29 |
| 4,391,048 | A | 7/1983 | Lutz | 36/28 |
| 4,397,104 | A | 8/1983 | Doak | 36/29 |
| 4,446,634 | A | 5/1984 | Johnson et al. | 36/29 |
| 4,449,307 | A | 5/1984 | Stubblefield | 36/32 |
| 4,461,099 | A * | 7/1984 | Bailly | 36/44 |
| 4,472,890 | A | 9/1984 | Gilbert | 36/28 |
| 4,610,099 | A | 9/1986 | Signori | 36/3 B |
| 4,729,179 | A | 3/1988 | Quist, Jr. | |
| 5,170,572 | A * | 12/1992 | Kantro | 36/43 |
| 5,465,508 | A * | 11/1995 | Bourdeau | 36/44 |
| 6,092,311 | A * | 7/2000 | MacNamara | 36/97 |

(Continued)

FOREIGN PATENT DOCUMENTS

DE 4202159 A 19930729 7/1993

(Continued)

OTHER PUBLICATIONS

Photographs of thermo formed, dimpled insoles manufactured by Jun Yang, dated Oct. 5, 2001 (photos are copies of the same samples Examiner Kavanaugh in person on May 31, 2005).

*Primary Examiner*—Ted Kavanaugh
(74) *Attorney, Agent, or Firm*—Frost Brown Todd LLC

(57) ABSTRACT

The present invention provides for a tufted foam insole for use in slippers or other footwear. The present invention also provides for tufted footwear. A plurality of tufts in a foam pad provide for a firm but yet cushy feel to a user's foot.

22 Claims, 2 Drawing Sheets

U.S. PATENT DOCUMENTS 6,112,432 A * 9/2000 Bray et al. ..... 36/44

FOREIGN PATENT DOCUMENTS

| | | |
|---|---|---|
| GB | 742787 | 1/1956 |
| GB | 807269 | 1/1959 |
| GB | 2 130 072 A | 5/1984 |
| GB | 2 358 121 A | 7/2001 |
| WO | WO 79/00210 | 4/1979 |

* cited by examiner

TUFTED FOAM INSOLE AND TUFTED FOOTWEAR

FIELD OF THE INVENTION

The present invention relates to footwear in general and to tufted footwear in particular.

BACKGROUND OF THE INVENTION

The use of foam in footwear is well known. The use of foam as an insole provides a cushy feel to a foot. However, the very characteristics of the foam which provide a cushy feel to the foot, can also contribute to an unsupportive or lack of firmness to the particular shoe or slipper.

It is desirable to have a cushy but also supportive feel in slippers or other footwear designed primarily for comfort and relaxation. However, while the use of foam enhances the cushy feel to the foot, foam, in and of itself, often lacks the desired support and firmness. Accordingly, there is a need to achieve both a supportive and cushy footwear, that provides a comfortable yet firm feel to the foot.

OBJECTS OF THE INVENTION

Accordingly, it is an object of the present invention to provide an insert for footwear that provides a supportive yet cushy feel. It is also an objective of the present invention to provide footwear that also is supportive and comfortable.

SUMMARY OF THE INVENTION

The present invention achieves these objects and others by utilizing a tufted foam insert. A plurality of tufts and a standard or high density foam pad are used to provide a cushy but firm insole. The present invention also utilizes a tufted foam insole in a slipper to also meet the objects of the present invention.

The above and other objects and advantages of the present invention shall be made apparent from the accompanying drawings and the descriptions thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE INVENTION

Figure 1:
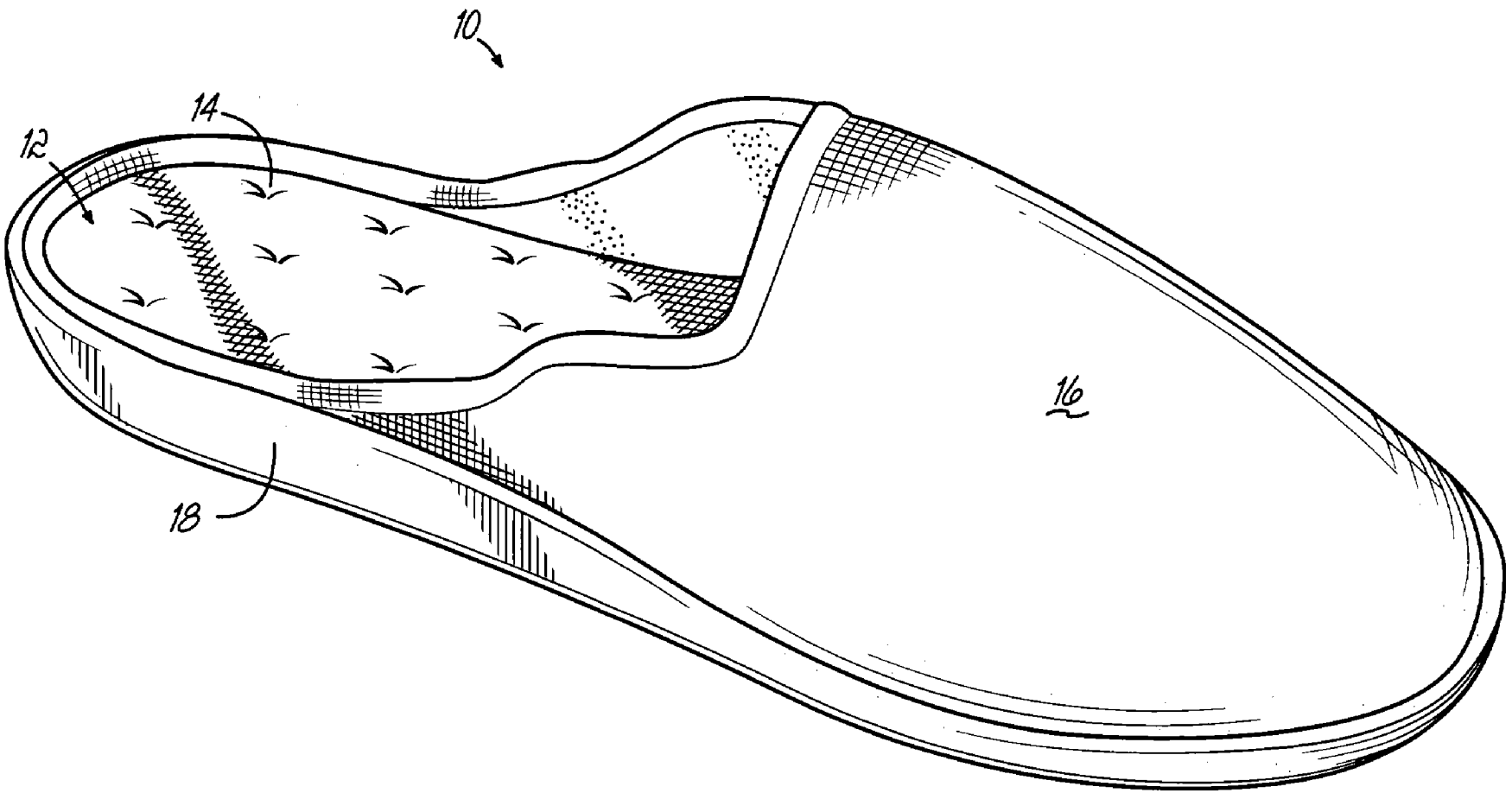
FIG. 1 is a perspective view of a slipper according to the principles of the present invention.

The footwear, shoe, or slipper 10 shown in FIG. 1 contains a sock or insole 12 with a plurality of tufts 14. The slipper 10 also contains a vamp lining 16 and an outsole 18. While illustrated as a slipper, the slipper 10 could be any type of footwear.

Figure 2:
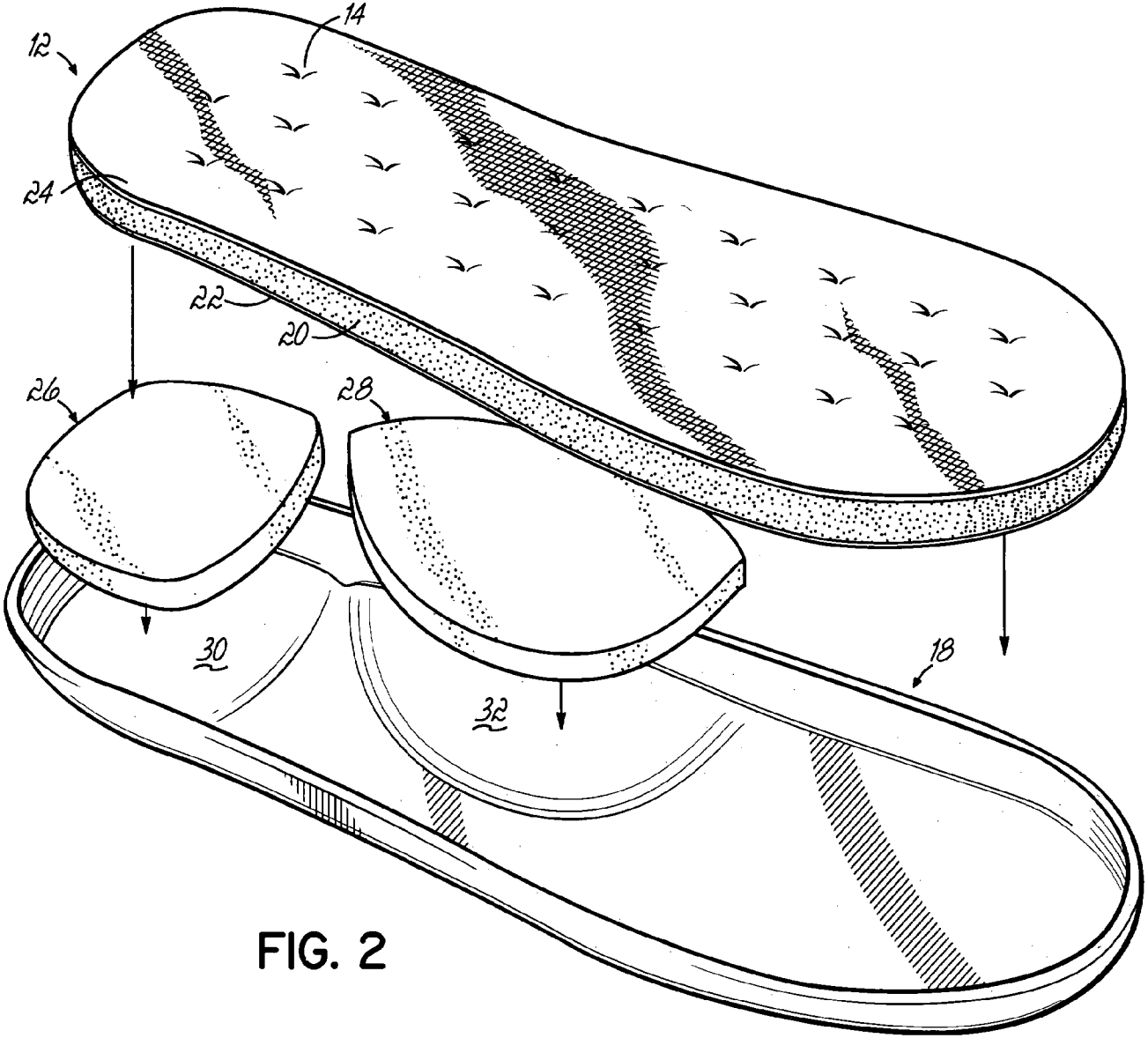
FIG. 2 is a disassembled view of some of the components of the slipper shown in FIG. 1.

As shown in FIG. 2, the insole 12 includes a tufted foam pad 20. In one embodiment, this foam pad 20 is approximately 13 mm. (0.5 inches) thick and is comprised of high density foam. A binding 22 is attached to the bottom surface of a foam pad 20. An insole liner 24 is attached to the top surface of the foam pad. The insole liner 24 may be velour to provide a plumptious feel to the foot. Additionally, the tufts 14 can extend from the binding 22 through the foam pad 20 to the insole liner 24. In so doing, a puffy and firm insole 12 is created.

Additionally, a heel cushion 26 can be sandwiched between the insole 12 and the outsole 18. The heel cushion 26 can be comprised of a 9.5 mm. (⅜ in.) thick high density poly foam. Similarly, an arch cushion 28 can be sandwiched between the tufted foam insole 12 and the outsole 18. The arch cushion 38 can be comprised of a 9.5 mm. (⅜ in.) thick poly foam cookie.

The heel cushion 26 rests in the heel cradle 30 of the outsole 18. The arch cushion 28 rests in the arch support 32 of the outsole 18. Thus, an embodiment of the present invention utilizing both a heel cushion 26, an arch cushion 28 provide enhanced comfort zones and extra cushioning. The outsole 18 may also contain other comfort enhancing features such as a toe rest (not shown) or other contours for enhanced support and a comfortable feel.

The present invention also embodies a method for manufacturing an insole 12 comprising the steps of cutting a foam pad 20 and tufting the foam pad 20. In such a method, the foam pad 20 may be a high density foam pad and the method may further comprise the steps of attaching a binding 22 to the foam pad 20. Additionally, an insole liner 24, may be attached to the foam pad 20 and the insole liner 24 may be velour.

The present invention also embodies a method for manufacturing a slipper 10 comprising the steps of attaching a heel cushion 26 to an outer sole 18, attaching an arch cushion 28 to an outsole 18, and securing a tufted foam insole 12 over the heel cushion 26 and the arch cushion 28. In such a method, the heel cushion 26 and the arch cushion 28 could be a high density poly foam. Additionally, the outsole 18 could be contoured, and the insole 12 could be high density foam.

While the present invention has been illustrated by description of various embodiments and while these embodiments have been described in considerable detail, it is not the intention of the applicant to restrict or in any way limit the scope of the claims to such detail. Additional advantages and modifications will readily appear to those skilled in the art. The invention in its broader aspect is, therefore, not limited to the specific details, representative apparatus and method, and illustrative example shown and described. Accordingly, departures may be made from such details without departing from the spirit or scope of the applicant's general inventive concept.

What is claimed is:

1. An insole comprising:

a high density foam pad having a top surface and a bottom surface;

wherein the foam pad is tufted with individual stitched tufts that form localized compressed areas in the foam pad and that are substantially evenly spaced across the top of the foam pad.

2. The insole of claim 1 further comprising a binding secured to the bottom surface of the foam pad.

3. The insole of claim 1 further comprising an insole liner attached to the top surface of the foam pad.

4. The insole of claim 3 wherein the insole liner is velour.

5. A velour insole for a slipper comprising:

a high density foam pad having a top surface and a bottom surface;

a binding secured to the bottom surface of the foam pad;

a velour insole liner attached to the top surface of the foam pad; and wherein the foam pad is tufted with individual stitched tufts that form localized compressed areas in the foam pad and that are substantially evenly spaced across the top of the foam pad.

6. A slipper comprising:

a tufted foam insole having individual stitched tufts that form localized compressed areas in the foam pad and that are substantially evenly spaced across the top of the foam pad; and an outsole.

7. The slipper of claim 6 wherein the tufted foam insole is a tufted high density foam pad.

8. The slipper of claim 6 wherein the outsole is contoured.

9. The slipper of claim 6 further comprising a binding attached to the foam insole.

10. The slipper of claim 6 further comprising an insole liner attached to the foam insole.

11. The slipper of claim 10 wherein the insole liner is velour.

12. The slipper of claim 6 further comprising a heel cushion sandwiched between the tufted foam insole and the outsole.

13. The slipper of claim 12 wherein the heel cushion is a high density poly foam.

14. The slipper of claim 6 further comprising an arch cushion sandwiched between the tufted foam insole and the outsole.

15. The slipper of claim 14 wherein the arch cushion is a highly density poly foam.

16. A slipper comprising:

a tufted high density foam pad having individual stitched tufts that form localized compressed areas in the foam pad and that are substantially evenly spaced across the top of the foam pad;

a binding attached to the foam insole;

a velour insole liner attached to the foam insole;

a contoured outsole;

a high density poly foam heel cushion sandwiched between the tufted high density foam pad and the contoured outsole; and a high density poly foam arch cushion sandwiched between the tufted high density foam pad and the contoured outsole.

17. A method for manufacturing a slipper comprising:

attaching a heel cushion to an outsole;

attaching an arch cushion to the outsole; and securing a tufted foam insole having individual stitched tufts that form localized compressed areas in the foam pad and that are substantially evenly spaced across the top of the foam pad over the heel cushion and the arch cushion.

18. The method of claim 17 wherein the heel cushion is a high density poly foam.

19. The method of claim 17 wherein the arch cushion is a high density poly foam.

20. The method of claim 17 wherein the outsole is contoured.

21. The method of claim 17 wherein the tufted foam insole is tufted high density foam insole.

22. A method for manufacturing a slipper comprising:

attaching a high density poly foam heel cushion to a contoured outsole;

attaching a high density poly foam arch cushion to the contoured outsole; and securing a tufted high density foam insole having individual stitched tufts that form localized compressed areas in the foam pad and that are substantially evenly spaced across the top of the foam pad over the heel cushion and the arch cushion.

* * * * *